US011607782B2

(12) United States Patent
Hutchison et al.

(10) Patent No.: US 11,607,782 B2
(45) Date of Patent: Mar. 21, 2023

(54) RIGHT ANGLE ADAPTER

(71) Applicant: Snap-on Incorporated, Kenosha, WI (US)

(72) Inventors: Allen M. Hutchison, Beach Park, IL (US); William J. Powell, Racine, WI (US); Jonathan I. Andersen, Mt. Pleasant, WI (US)

(73) Assignee: Snap-on Incorporated, Kenosha, WI (US)

( * ) Notice: Subject to any disclaimer, the term of this patent is extended or adjusted under 35 U.S.C. 154(b) by 292 days.

(21) Appl. No.: 16/442,954

(22) Filed: Jun. 17, 2019

(65) Prior Publication Data

US 2020/0391359 A1 Dec. 17, 2020

(51) Int. Cl.

| | |
|---|---|
| ***B25B 27/14*** | (2006.01) |
| ***B25B 23/00*** | (2006.01) |
| ***B25B 13/48*** | (2006.01) |
| ***B25G 1/04*** | (2006.01) |

(52) U.S. Cl.

CPC ..... *B25B 23/0035* (2013.01); *B25B 13/481* (2013.01); *B25B 23/0028* (2013.01); *B25G 1/043* (2013.01)

(58) Field of Classification Search

CPC ..... B25B 23/0028; B25B 23/0035; B25G 1/043

See application file for complete search history.

(56) References Cited

U.S. PATENT DOCUMENTS

| | | | |
|---|---|---|---|
| 1,171,063 | A | 2/1916 | Nigborowicz |
| 1,435,288 | A | 11/1922 | Gifford et al. |
| 1,954,820 | A | 4/1934 | Kress |
| 1,982,008 | A | 11/1934 | Mandl et al. |
| 2,558,131 | A | 6/1951 | Green |
| 2,783,799 | A | 3/1957 | Hart |
| 2,808,641 | A | 10/1957 | Sandell |
| 2,896,212 | A | 7/1959 | Werstein |
| 3,381,730 | A | 5/1968 | Omholt |
| 3,733,936 | A | 5/1973 | Flynn |
| 4,008,741 | A | 2/1977 | Holstein |
| 4,390,050 | A | 6/1983 | Whitney |
| 4,403,725 | A | 9/1983 | Lawrence |

(Continued)

FOREIGN PATENT DOCUMENTS

| | | |
|---|---|---|
| GB | 2564730 A | 1/2019 |
| TW | M344948 | 11/2008 |

(Continued)

OTHER PUBLICATIONS

Combined Search Report and Examination Report for Application No. GB2004578.7 dated Sep. 30, 2020, 6 pages.

(Continued)

*Primary Examiner* — Joseph J Hail

*Assistant Examiner* — Shantese L McDonald

(74) *Attorney, Agent, or Firm* — Seyfarth Shaw LLP

(57) ABSTRACT

An adapter for a bearing race and seal driver tool that allows the tool to be used in hard to reach applications. The adapter connects to a driver and a handle at a non-zero angle, for example a right angle, to allow the adapter to be struck at a face of the adapter rather than the handle to be struck at an end of the handle. A pocket is included at one or more connection points between the adapter and the handle or driver to resist rotational movement of the handle or driver.

24 Claims, 8 Drawing Sheets

(56) References Cited

U.S. PATENT DOCUMENTS

| | | | | |
|---|---|---|---|---|
| 4,703,677 | A | 11/1987 | Rossini | |
| D297,400 | S | 8/1988 | Oakes | |
| 4,784,025 | A | 11/1988 | Peck | |
| 4,813,308 | A | 3/1989 | Petrus | |
| 5,842,389 | A | 12/1998 | Halstead | |
| 5,943,924 | A * | 8/1999 | Jarvis | B25G 1/043 81/177.2 |
| 6,009,776 | A | 1/2000 | Warren | |
| 7,000,301 | B2 * | 2/2006 | Moushon | B25B 27/0028 29/255 |
| 7,040,200 | B2 | 5/2006 | Lin | |
| 7,228,766 | B1 * | 6/2007 | Shyu | B25B 13/005 81/125.1 |
| 7,707,709 | B2 | 5/2010 | Whitehead | |
| 8,584,554 | B2 | 11/2013 | Chen | |
| 9,486,901 | B2 | 11/2016 | Tsai | |
| 9,884,412 | B2 | 2/2018 | Chen | |
| 10,052,750 | B2 | 8/2018 | Huang | |
| 2005/0252348 | A1 * | 11/2005 | Ting | B25G 1/046 81/177.5 |
| 2006/0037184 | A1 | 2/2006 | Miller | |
| 2013/0067710 | A1 | 3/2013 | Williams et al. | |

FOREIGN PATENT DOCUMENTS

| | | |
|---|---|---|
| TW | M367061 | 10/2009 |
| TW | I317677 | 12/2009 |
| TW | 201024052 | 7/2010 |
| TW | 201024052 A | 7/2010 |
| TW | M397882 | 2/2011 |
| TW | I351335 | 11/2011 |
| TW | M499990 | 5/2015 |
| TW | I501844 | 10/2015 |
| TW | I530373 | 4/2016 |
| TW | M563493 | 7/2018 |
| TW | M573272 | 1/2019 |
| TW | M574100 | 2/2019 |
| TW | 201912340 | 4/2019 |

OTHER PUBLICATIONS

Taiwan Office Action for Application No. 11020070760 dated Jan. 26, 2021, 9 pages.

Examination Report for Application No. 2020202184 dated Mar. 26, 2021, 4 pages.

Canadian Office Action for corresponding CA Application No. 3,082,220, dated Jun. 30, 2021, 4 pages.

United Kingdom Search Report for corresponding UK Application No. GB2112394.8, dated Sep. 14, 2021, 4 pages.

Canadian Office Action for corresponding Application No. 3,082,220 dated Dec. 31, 2021, 4 pages.

Australian Examination Report No. 2 for corresponding AU Application No. 2020202184, dated Feb. 8, 2022, 4 pages.

* cited by examiner

RIGHT ANGLE ADAPTER

TECHNICAL FIELD OF THE INVENTION

The present invention relates generally to tool adapters. More particularly, the present invention relates to a strikeable right angle adapter for a hand tool.

BACKGROUND OF THE INVENTION

Bearings are used in many rotating applications to allow relative movement between two objects. Bearings consist of outer and inner races with rolling elements located in between. The rolling elements allow the outer and inner races to move relative to each other, typically in a circular motion, with reduced friction. Also, seals are often used with bearing to seal the bearings and races to reduce contamination and maintain lubricants, such as grease. However, bearings and seals require periodic maintenance and/or replacement.

Bearing race and seal driver sets allow a user to install bearing races or seals with a simple hand tool. For example, a prior art bearing race and seal driver set is depicted in FIG. 8. Referring to FIG. 8, a prior art tool 800 includes a handle 805, a driver 810, and a fastener 815. The handle 805 inserts into an opening of the driver 810 and is fastened to the handle 805 with the fastener 815. In lieu of a conventional fastener, the fastener 815 can be a ball bearing attachment where the handle 805 connects to the driver 810 via a ball bearing and groove arrangement. The tool 800 can then be used to install a bearing race or seal into the necessary groove or opening.

Bearing race and seal drivers are often used in hard to reach applications where it can be difficult to strike the tool 800 and install the bearing race or seal in the confined space. Conventional bearing race and seal drivers are normally not suited for such operations and require large amounts of space to be used properly. It is also advantageous to improve the structural stability of the connection points between the components of the bearing race and seal driver that are coupled together.

SUMMARY OF THE INVENTION

The present invention broadly comprises an adapter for a bearing race and seal driver that allows the driver to couple to the handle at an angle, such as a right angle, to allow use of the tool in hard to reach places. The adapter can include a first connection point on one face of the adapter for the handle and a second connection point on another face of the adapter, located at an angle to the first face, for coupling to the driver. A pocket can be provided on at least one of the two faces to resist rotational movement of the components coupled together and improve the structural stability of the assembly.

In particular, the present invention broadly comprises a tool including a handle that has first and second opposite ends, the handle includes a grip that extends from its first end, and a neck that extends from the grip towards the second end. The assembly further includes an adapter with first and second faces angled at a non-zero angle relative to one another, the adapter has a body with an adapter shaft that extends from the body at the second face, and an adapter bore defined within the body from the first face. Also included is a driver having a bore defined therein. The driver is configured to removably couple to the adapter at the second face, and the neck is configured to removably couple to the adapter at the second first face.

The present invention also broadly comprises an adapter configured to couple with a handle and driver. The adapter includes an adapter body having first and second faces angled at a non-zero angle relative to one another, where the adapter body has a bore defined therein configured to removably couple with a handle at the second first face, and the handle includes first and second opposite ends, a grip extending from the first end, and a neck that extends from the handle towards the second end, and an adapter shaft that extends from the body at the second face, the adapter shaft is configured to removably couple to a driver at the second face, the driver has a bore wherein the adapter shaft removably couples.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
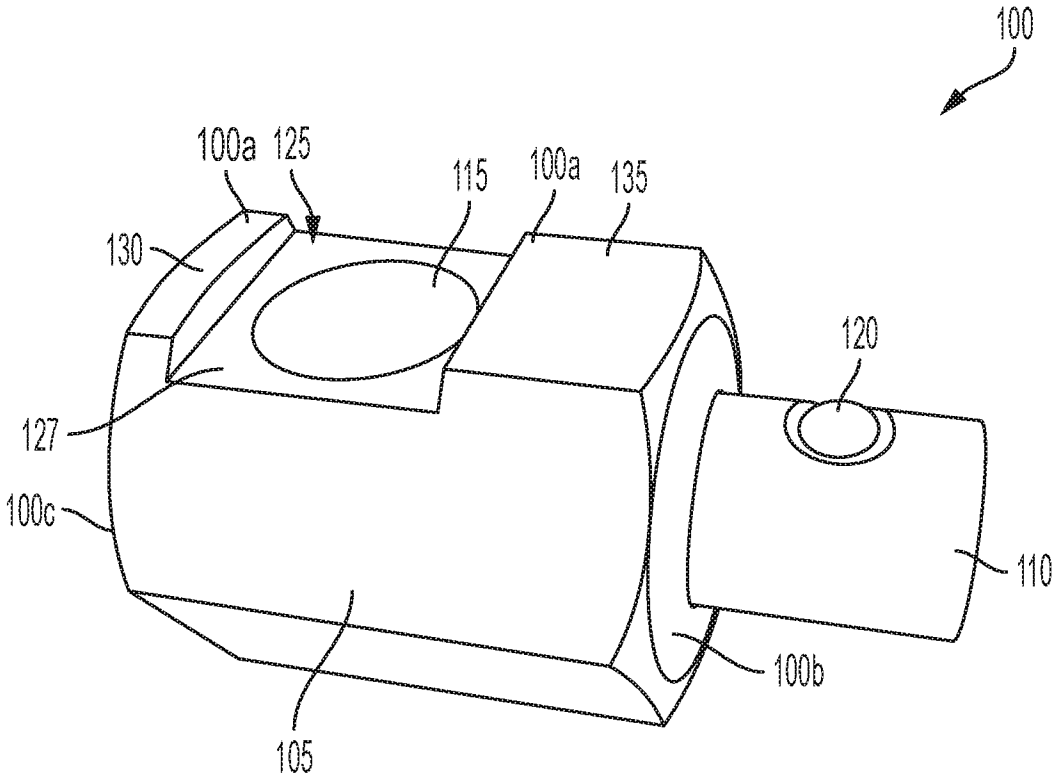
FIG. 1 is a side perspective view of an adapter according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises an adapter for a bearing race and seal driver tool that allows use of the tool in hard to reach places. The adapter can include connection points where a handle and driver can couple to the adapter at a non-zero angle, for example a right angle. A pocket can be provided on at least one of the two faces of the adapter to limit rotational movement of the components while they are connected together.

FIG. 1 illustrates an adapter 100 according to an embodiment of the present invention. As shown, the adapter 100 includes first 100*a* and second 100*b* faces located at a non-zero angle relative to one another, for example a right angle; and a striking face 100*c* where the adapter 100 can be struck. The adapter 100 can further include an adapter body 105 with an adapter shaft 110 that extends from the adapter body 105 at the second face 100*b*. The first face 100*a* can have an adapter bore 115 defined therein for receiving a handle, as disclosed below, and the adapter shaft 110 can include an adapter ball detent 120 that detachably couples to a driver, also disclosed below. In this manner, the driver and handle can detachably couple together at a non-zero angle via the adapter 100 and allow the user to strike the adapter 100 during use in hard to reach places, rather than being required to strike the handle, which requires more space.

The adapter 100 can include a pocket 125 located on either the first 100*a* or second 100*b* face to resist rotational movement of the components coupled to the respective faces 100*a,b*. The pocket 125 can include a pocket face 127 with a lip 130 and a plateau 135 at opposite sides of the pocket face 127. In an embodiment, the lip 130 and plateau 135 can be located adjacent to one another, rather than opposite to one another, or in any other configuration that would help resist rotational movement of one or more components coupled to the respective faces 100*a,b*.

Figure 2:
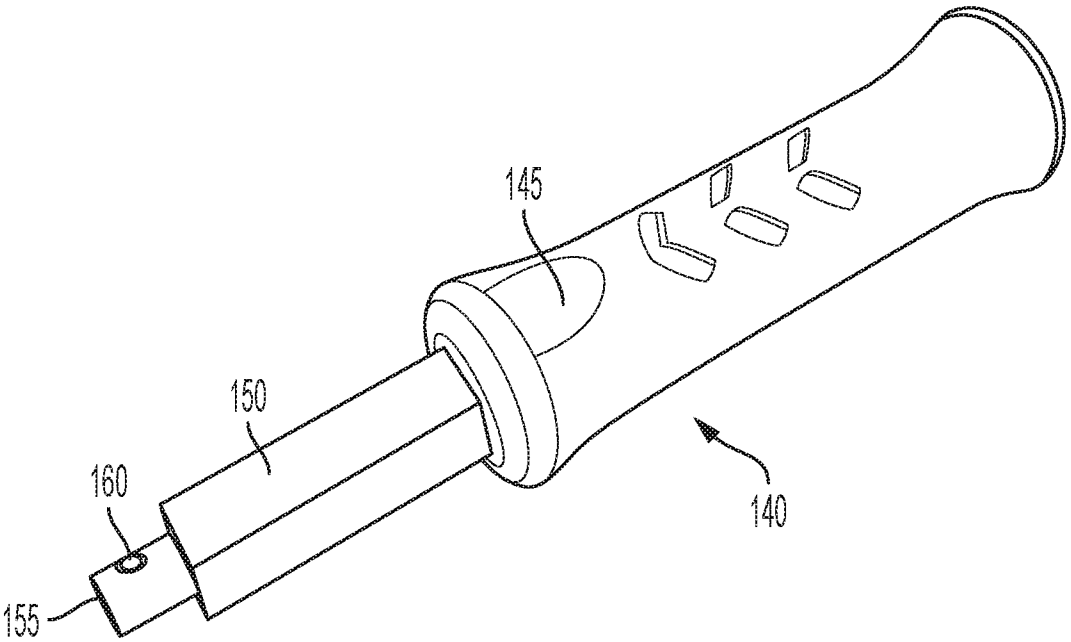
FIG. 2 is a side perspective view of a handle according to an embodiment of the present invention.

FIG. 2 illustrates a handle 140 according to an embodiment of the present invention. As shown, the handle 140 includes first and second opposite ends with a grip 145 at the first end that extends to a neck 150. A handle shaft 155 can extend from the neck 150 to the second end and can include a handle ball detent 160 that couples with the adapter 100 within the adapter bore 115.

Figure 3:
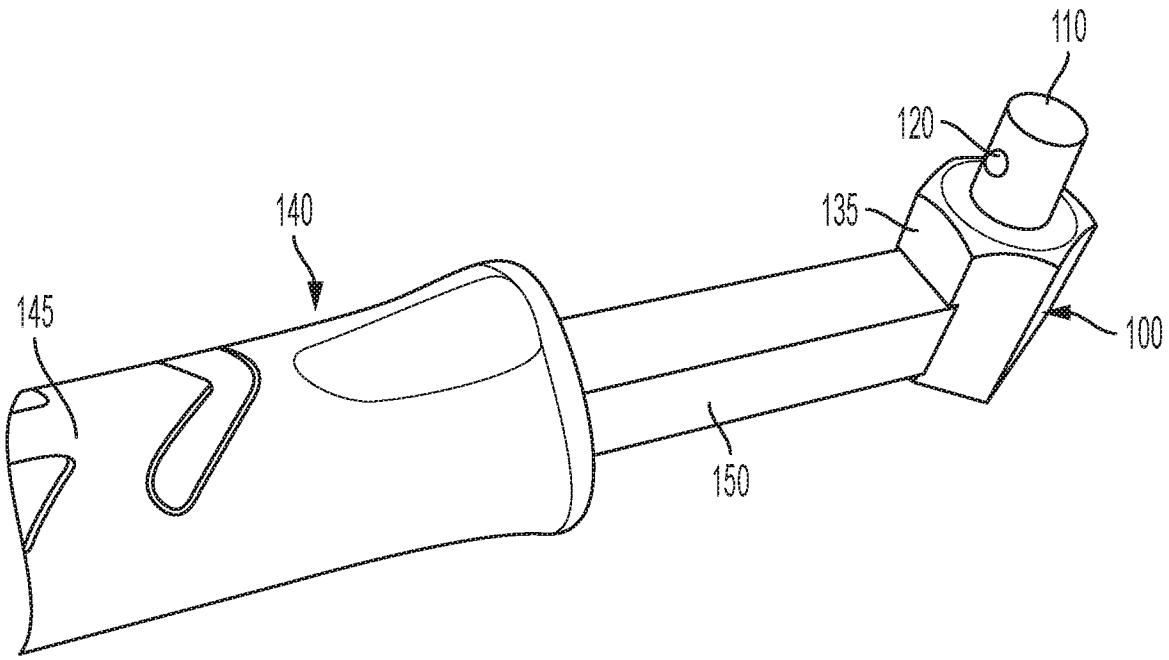
FIG. 3 is a side perspective partial view of a handle and adapter coupled together according to an embodiment of the present invention.

As shown, in an embodiment, the neck 150 can have a square or rectangular cross-section and the handle shaft 155 can have a circular cross-section. In this embodiment the shape of the neck 150 can be the same as that of the pocket face 127 and the shape of the handle shaft 155 can be the same as the adapter bore 115 to allow a reversible coupling of the handle 140 to the adapter 100. For example, the pocket 125 can include a square pocket face 127 (as shown in FIG. 1) to cooperatively receive a square cross-section neck 150, and the adapter bore 115 can receive a handle shaft 155 with a ball detent coupling from the handle ball detent 160. In this manner, the lip 130 and plateau 135 can resist rotational movement of the neck 150 due to the cooperative engagement of the pocket 125 and the neck 150, as shown in FIG. 3.

Figure 4:
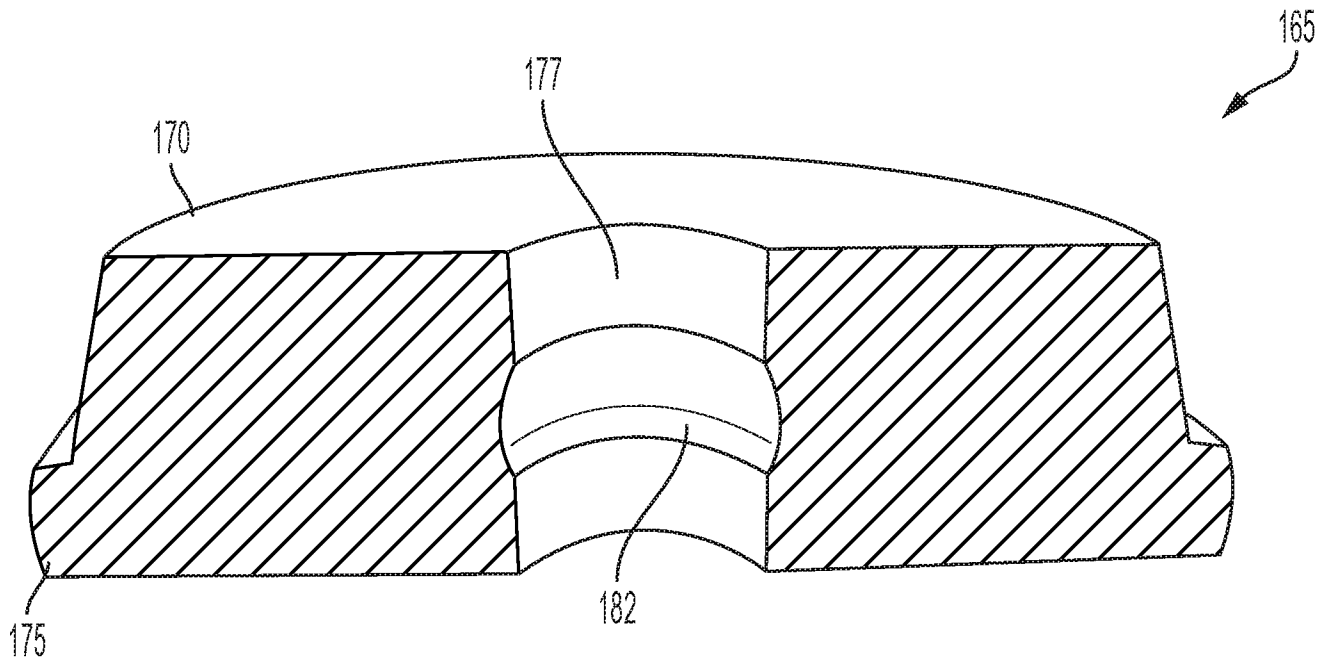
FIG. 4 is a side perspective sectional view of a driver, taken along line 4-4 of FIG. 5 according to an embodiment of the present invention.

FIG. 4 illustrates a side perspective sectional view of a driver 165 according to an embodiment of the present invention. As shown, the driver 165 includes a body 170 and a perimeter 175 extending around the body 170 on one side of the body 170. A bore 177 is defined within the driver 165 and includes a groove 182 for receiving the adapter ball detent 120. In this manner, the driver 165 can removably or detachably couple to the adapter 100 through a ball detent mechanism. However, any other coupling mechanism can be implemented without departing from the spirit and scope of the present invention.

Figure 5:
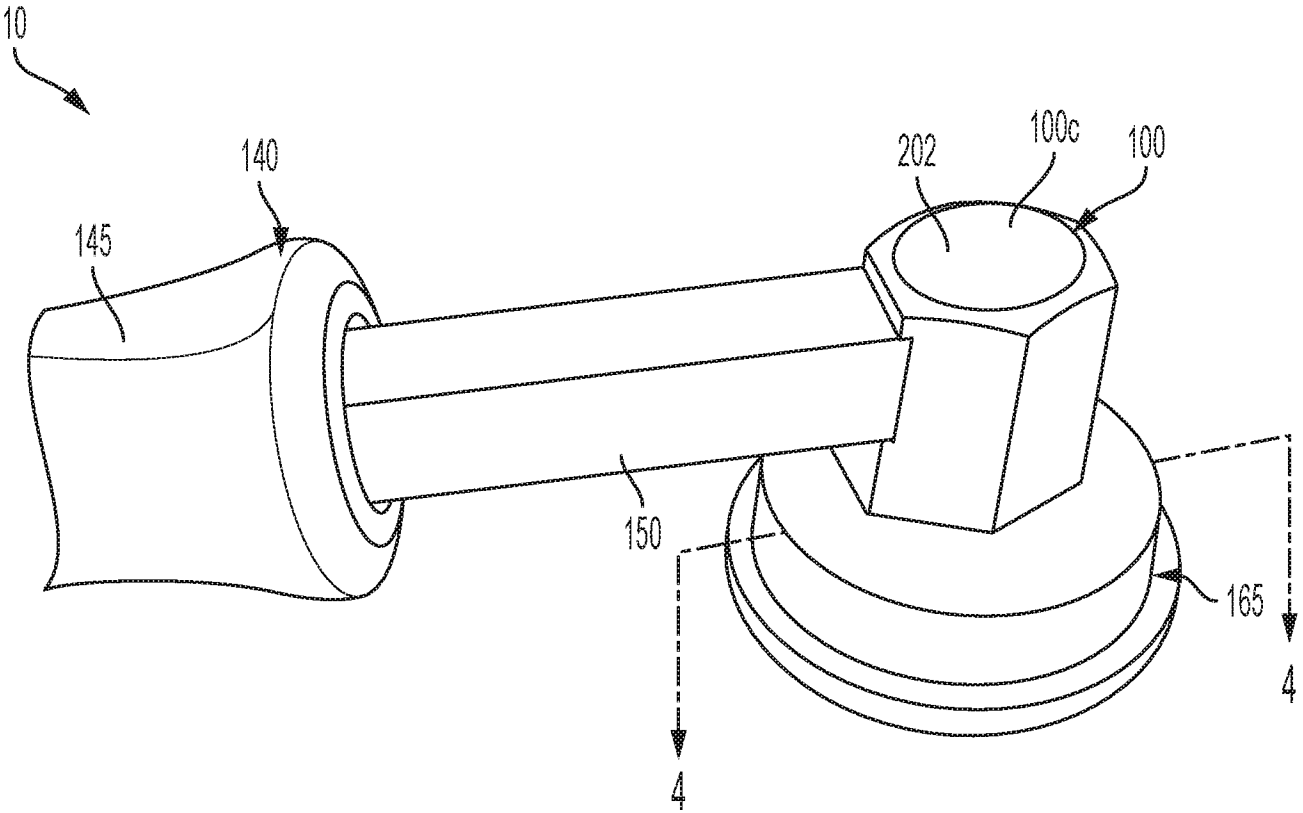
FIG. 5 is a side, enlarged perspective partial view of a handle, adapter, and driver assembled together as a tool according to an embodiment of the present invention.
Figure 6:
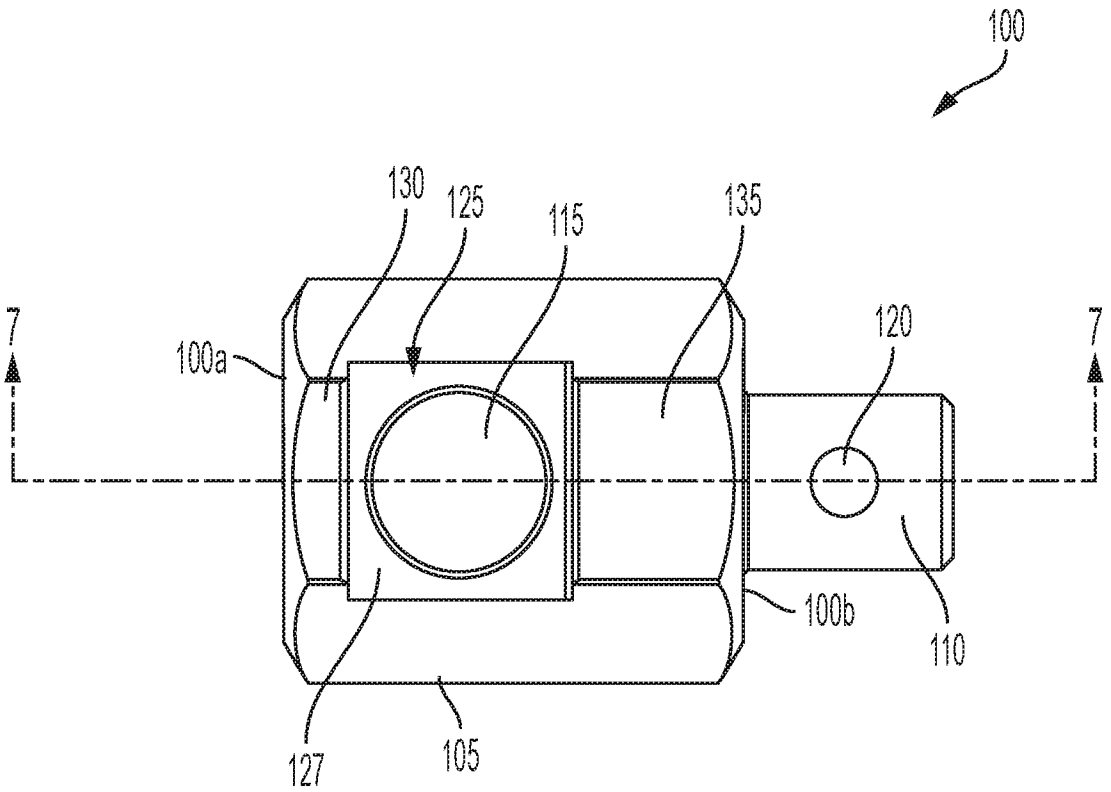
FIG. 6 is a side view of an adapter according to an embodiment of the present invention.
Figure 7:
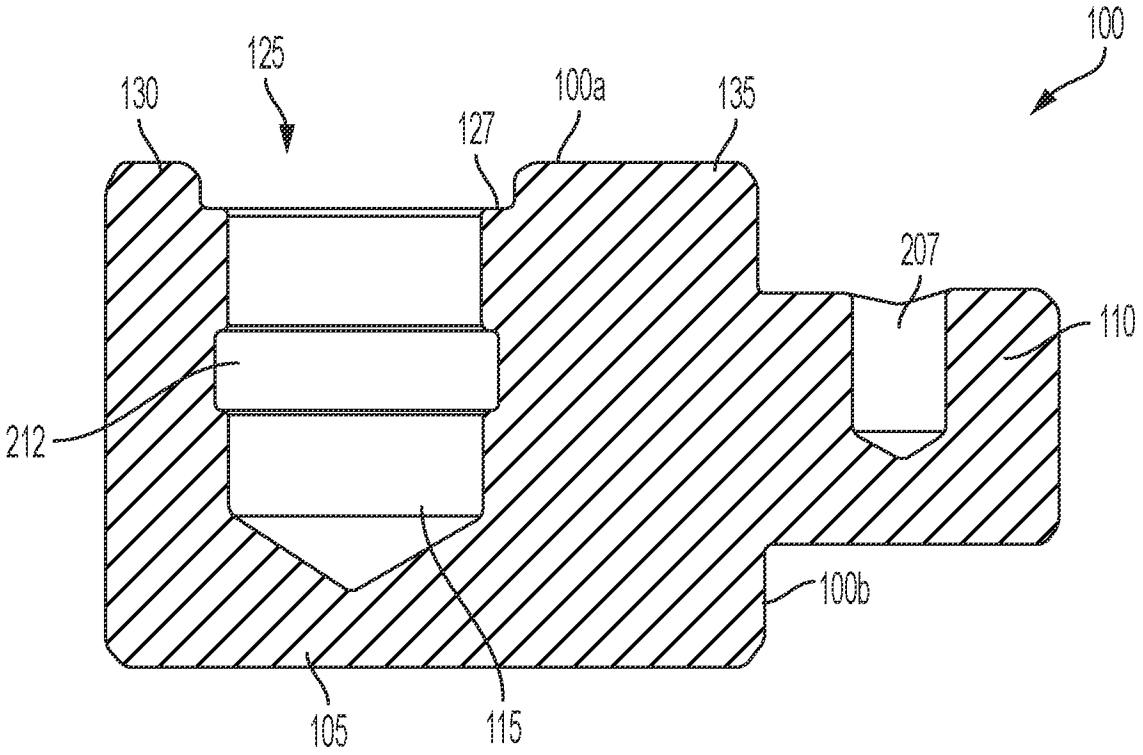
FIG. 7 is a side sectional view of an adapter taken from line 7-7 in FIG. 6 according to an embodiment of the present invention.
Figure 8:
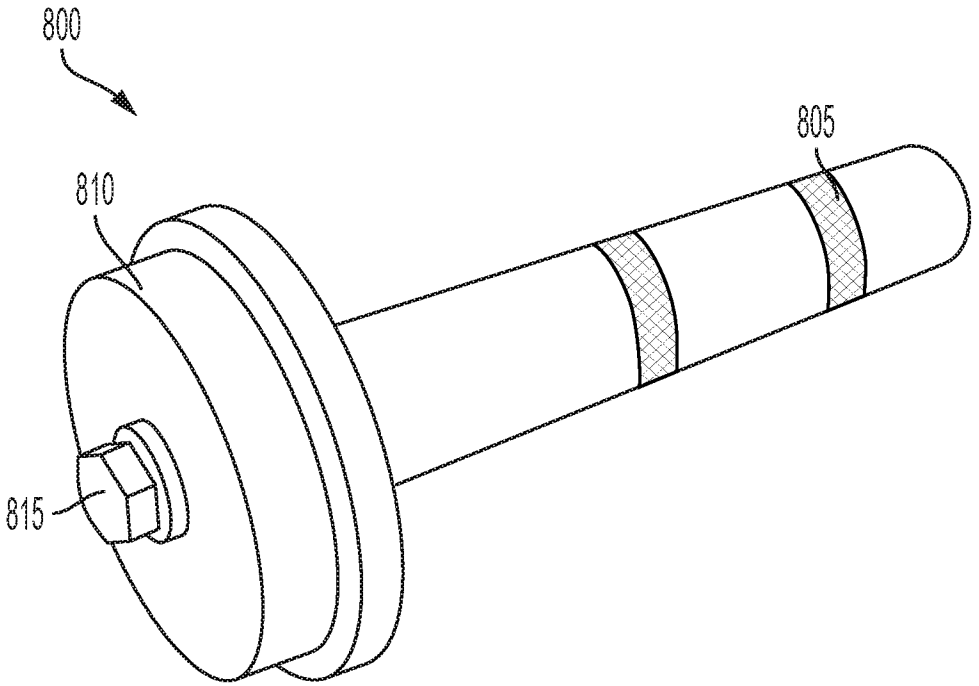
FIG. 8 PRIOR ART
FIG. 8 is side perspective view of a prior art tool.

FIG. 5 illustrates the handle 140 and driver 165 detachably coupled together. As shown, the striking face 100*c* can be shaped as a dome 202 in certain embodiments, however the present invention is not so limited. The striking face 100*c* can be shaped flat, domed, or any other shape that allows striking of the adapter 100. Referring to FIGS. 6 and 7, the adapter 100 can include a ball detent opening 207 for receiving the ball of the adapter ball detent 120 at the adapter shaft 110. The adapter bore 115 can include an adapter groove 212 for cooperatively engaging the handle ball detent 160 of the handle shaft 155. For example, the handle 140 can be inserted into the bore 115 and the handle ball detent 160 can be pushed inwardly inside the handle shaft 155 against the bias of a spring associated with the handle ball detent 160. As the handle shaft 155 is pushed further into the bore 115, the ball of the handle ball detent 160 can be pushed outwardly with the bias of the handle ball detent 160 and removably or detachably couple the handle 140 to the adapter 100. To remove the driver 140, the user can simply pull the handle shaft 155 out of the adapter bore 115 in a motion opposite to that described above.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

a handle having opposing first and second ends, the handle includes a grip extending from the first end, and a neck extending from the grip towards the second end;

an adapter having an adapter body with first, second, and third faces, wherein the first and second faces are angled at a non-zero angle relative to each other, the third face is disposed on the adapter body opposite the second face and is adapted to allow the adapter to be struck, an adapter shaft extending from the second face, and an adapter bore and a pocket are defined within the adapter body at the first face; and a driver having a bore defined therein, wherein the driver is configured to removably couple to the adapter shaft, and the neck is configured to removably couple to the adapter at the first face, and wherein the pocket includes a pocket face with a pocket face shape corresponding to a neck cross-section shape of the neck of the handle such that the pocket restricts rotational movement of the handle relative to the adapter.

2. The tool of claim 1, further comprising an adapter ball detent located on the adapter shaft and configured to removably couple with the driver.

3. The tool of claim 1, further comprising a handle ball detent located proximate the second end of the handle and configured to removably couple with the first face of the adapter.

4. The tool of claim 1, wherein the pocket includes a lip and a plateau at least partially surrounding the pocket face.

5. The tool of claim 4, wherein the lip and plateau are located on opposite sides of the pocket face.

6. The tool of claim 1, wherein the non-zero angle is a right angle.

7. An adapter configured to removably couple with a handle and driver, the adapter comprising:

an adapter body having first, second, and third faces, wherein the first and second faces are angled at a non-zero angle relative to one another, the third face is disposed on the adapter body opposite the second face and is a striking face adapted to allow the adapter to be struck, a bore and pocket are defined in the adapter body at the first face, wherein the handle has opposing first and second ends and includes a grip extending from the first end, and a neck extending from the grip towards the second end and removably coupled to the adapter body at the first face, and wherein the pocket includes a pocket face with a pocket face shape corresponding to a neck cross-section shape of the neck of the handle such that the pocket restricts rotational movement of the handle relative to the adapter; and an adapter shaft extending from the adapter body at the second face and configured to removably couple to a driver bore.

8. The adapter of claim 7, further comprising an adapter ball detent located on the adapter shaft and configured to detachably couple with the driver.

9. The adapter of claim 7, wherein the adapter bore further includes a groove configured to engage a handle ball detent located proximate the second end of the handle to detachably couple with the first face of the adapter.

10. The adapter of claim 7, wherein the pocket includes a lip and a plateau at least partially surrounding the pocket face.

11. The adapter of claim 10, wherein the lip and plateau are located on opposite sides of the pocket face.

12. The adapter of claim 7, wherein the non-zero angle is a right angle.

13. An adapter for a bearing race and seal driver tool configured to removably couple with a handle and driver of the tool, the adapter comprising:

an adapter body having first, second, and third faces, wherein the first and second faces are angled at a non-zero angle relative to one another, the third face is disposed on the adapter body opposite the second face and is a striking face adapted to allow the adapter to be struck, the first face is configured to removably couple with the handle and includes a pocket formed therein, wherein the pocket includes a pocket face with a pocket face shape corresponding to a neck cross-section shape of the neck of the handle such that the pocket restricts rotational movement of the handle relative to the adapter, and the second face is configured to removably couple to the driver.

14. The adapter of claim 13, wherein the striking face is shaped as a dome.

15. The adapter of claim 13, wherein an adapter bore is a blind bore defined in the first face and includes a groove configured to engage a handle ball detent located proximate an end of the handle.

16. The adapter of claim 15, wherein the pocket includes a lip and a plateau at least partially surrounding the pocket face.

17. The adapter of claim 16, wherein the lip and plateau are located on opposite sides of the pocket face.

18. The adapter of claim 13, wherein the non-zero angle is a right angle.

19. An adapter configured to removably couple with a handle and driver, the adapter comprising:

an adapter body having first, second, and third faces, wherein the first and second faces are angled at a non-zero angle relative to each other, the third face is disposed on the adapter body opposite the second face and is adapter to be struck, a bore defined in the adapter body configured to removably couple with a handle at the first face, wherein the handle has opposing first and second ends and includes a grip extending from the first end, and a neck extending from the grip towards the second end; and an adapter shaft extending from the adapter body at the second face and configured to removably couple to a driver bore, wherein the adapter shaft has a cylindrical cross-sectional shape.

20. The adapter of claim 19, further comprising an adapter ball detent located on the adapter shaft and configured to detachably couple with the driver.

21. The adapter of claim 19, wherein the adapter bore further includes a groove configured to engage a handle ball detent located proximate the second end of the handle to detachably couple with the first face of the adapter.

22. The adapter of claim 19, further comprising a pocket defined within the first face and having a pocket face with a pocket face shape corresponding to a neck cross-section shape of the neck of the handle.

23. The adapter of claim 22, wherein the pocket includes a lip and a plateau at least partially surrounding the pocket face.

24. The adapter of claim 23, wherein the lip and plateau are located on opposite sides of the pocket face.

* * * * *